US005447578A

United States Patent [19]

Ozaki et al.

[11] Patent Number: 5,447,578

[45] Date of Patent: Sep. 5, 1995

[54] CORROSION-RESISTANT RARE EARTH METAL-TRANSITION METAL SERIES MAGNETS AND METHOD OF PRODUCING THE SAME

[75] Inventors: Yukiko Ozaki; Michio Shimotomai; Yasutaka Fukuda; Akira Fujita; Yoko Kitano; Junichi Shimomura, all of Chiba, Japan

[73] Assignee: Kawasaki Steel Corporation, Japan

[21] Appl. No.: 266,791

[22] Filed: Jun. 28, 1994

Related U.S. Application Data

[63] Continuation of Ser. No. 687,927, filed as PCT/JP90/01315, Oct. 11, 1990, abandoned.

[30] Foreign Application Priority Data

| | | | |
|---|---|---|---|
| Oct. 12, 1989 | [JP] | Japan | 1-263946 |
| Dec. 26, 1989 | [JP] | Japan | 1-355028 |
| Oct. 9, 1990 | [JP] | Japan | 2-269635 |

[51] Int. Cl.[6] ..... H01F 1/057

[52] U.S. Cl. ..... 148/302; 419/12; 75/244

[58] Field of Search ..... 148/302; 419/12; 75/244

[56] References Cited

U.S. PATENT DOCUMENTS 5,011,552 4/1991 Otsuka et al. ..... 148/302

FOREIGN PATENT DOCUMENTS

| | | |
|---|---|---|
| 0261579 | 3/1988 | European Pat. Off. . |
| 0311049 | 4/1989 | European Pat. Off. . |
| 63-93841 | 4/1988 | Japan . |
| 63-164403 | 7/1988 | Japan . |
| 63-254704 | 10/1988 | Japan . |
| 63-313807 | 12/1988 | Japan . |

*Primary Examiner*—John Sheehan

*Attorney, Agent, or Firm*—Parkhurst, Wendel & Rossi

[57] ABSTRACT

This invention provides permanent magnets that are excellent not only in magnetic properties but also corrosion resistance by using two magnetically useful phases, i.e., $RE_2TM_{14}B$ phase having a high residual magnetic flux density and a low melting point RE-TM' phase or RE-TM'-B phase which enhances the sinterability and possesses a cleaning action against grain boundaries of the $RE_2TM_{14}B$ main phase. Further the invention provides a method for forming an electrochemically noble composition as a starting material to prepare a two phase magnet.

2 Claims, 2 Drawing Sheets

1 --- $Nd_2Fe_{14}B$

2 --- $NdFe_4B_4$

3 --- $Nd_2FeB_3$

1 --- $Nd_2Fe_{14}B$
2 --- $NdFe_4B_4$
3 --- $Nd_2FeB_3$

1 --- $Nd_2Co_{14}B$
2 --- $NdCo_4B$
3 --- $Nd_3Co_{11}B_4$
4 --- $Nd_2Co_5B_2$
5 --- $Nd_2Co_7B_3$
6 --- ~$Nd_2Co_5B_3$
7 --- $NdCo_{12}B_6$
8 --- $NdCo_2B_2$
9 --- $NdCo_4B_4$
10 --- ~$Nd_2CoB_3$

CORROSION-RESISTANT RARE EARTH METAL-TRANSITION METAL SERIES MAGNETS AND METHOD OF PRODUCING THE SAME

This is a Continuation of application Ser. No. 07/687,927, filed as PCT/JP90/01315, Oct. 11, 1990, now abandoned.

TECHNICAL FIELD

This invention relates to rare earth metal-transition metal series magnets having not only excellent magnetic properties, but also improved corrosion resistance and temperature-dependent properties, and a method of producing the same.

BACKGROUND ART

As a typical permanent magnet manufactured at the present, there are known Alnico magnets, ferrite magnets, rare earth metal magnets and the like. The Alnico magnets have been manufactured for a very long time, but their demand is lowering in accordance with the development of cheap ferrite magnets and rare earth metal magnets having higher magnetic properties. On the other hand, the ferrite magnets are chemically stable and low in cost because oxides are used as a main starting material, so that they are the main source of magnetic material even at the present. However, ferrite magnets have a drawback in that the maximum energy product is small.

Recently, Sm—Co series magnets having a combination of magnetic isotropy inherent to rare earth metal ions and magnetic moment inherent to transition metal elements have been developed, whereby the conventional value of maximum energy product is largely increased. However, the Sm—Co series magnet is mainly composed of resourceless Sm and Co, so that it is obliged to become expensive.

Now, it has been attempted to develop cheap magnet alloys which do not contain expensive Sm and Co and have high magnetic properties. Consequently, Egawa et al. has developed stable ternary alloys by a sintering process (Japanese Patent Application Publication No. 61-34242 and Japanese Patent laid open No. 59-132104) and J. J. Groat et al. have developed alloys having a high coercive force by a liquid quenching process (Japanese Patent laid open No. 59-64739). These magnets are composed of Nd, Fe and B, and their maximum energy product exceeds that of Sm—Co series magnets.

However, Nd—Fe—B series magnets contain greater amounts of a light rare earth element such as Nd having very high activity or the like and corrosive Fe as a main component, so that the corrosion resistance is poor and hence the magnetic properties and reliability as an industrial material are degraded.

Therefore, in order to improve the corrosion resistance, countermeasures have been taken, such as surface plating (Japanese Patent laid open No. 63-77103), coating treatment (Japanese Patent laid open No. 60-63901) and the like on the sintered magnets, and surface treatment on resin bonded type magnets before kneading magnet powder with a resin and the like. However, such countermeasures can not be said to be an effective rustproof treatment over a long period of time, and the manufacturing cost becomes higher due to such a treatment. Further, such treatment results in problems such as magnetic flux loss due to the presence of the protective film and the like.

As a solution to the above problems, the inventors have previously proposed rare earth metal-transition metal-boron series magnet alloys in which Fe in the Nd—Fe—B series magnet is replaced with high concentrations of Co and Ni (Japanese Patent laid open No. 2-4939).

Such magnets are excellent in corrosion resistance and high in Curie point, so that the reliability as a magnet material is largely increased.

The present invention is concerned with rare earth metal-transition metal series magnets of two phase structure further developed from the above magnet.

Moreover, magnets having excellent magnetic properties through two alloying processes in which rare earth rich phase and rare earth poor phase are mixed and sintered at liquid phase state have previously been proposed as Nd series magnets of two phase structure (Japanese Patent laid open No. 63-93841 and No. 63-164403). In this case, the magnetic properties are improved, but there still remains the problem of corrosion resistance.

SUMMARY OF THE INVENTION

An object of the present invention is to advantageously solve the aforementioned problems and to propose rare earth metal-transition metal series magnets of two phase structure that are excellent not only in magnetic properties, but also in corrosion resistance, and a method of advantageously producing the same.

DETAILED DESCRIPTION OF THE INVENTION

At first, details of elucidating the invention will be described.

The inventors have made various metallographical studies on the above magnet using high resolution electron microscope or the like, and confirmed that this magnet contains $Nd_2(Fe, Co, Ni)_{14}B$ phase having a large saturated magnetic flux density, and intergranular phases surrounding crystal grains of the above phase and developing a strong coercive force, such as $Nd_2(Fe, Co, Ni)_{17}$, $Nd(Fe, Co, Ni)_5$, $Nd_2(Fe, Co, Ni)_7$, $Nd(Fe, Co, Ni)_4B$ and $Nd (Fe, Co, Ni)_{12}B_6$ and further $Nd_{1-x}TM_x$ of CrB structure (TM is mainly Ni) and the like.

Furthermore, it has been found that better corrosion resistance is exhibited as the amount of Nd phase, being a source of corrosion, is less and the concentration of Ni or Co in the above intergranular phase becomes high.

Now, the inventors have made further studies with respect to this point and found that the above intergranular phase hardly appears in a Nd—Fe—B ternary phase diagram other than $Nd_2(Fe, Co, Ni)_{17}$ and is rather a phase appearing only in the Nd—Co—B system.

Figure 1:
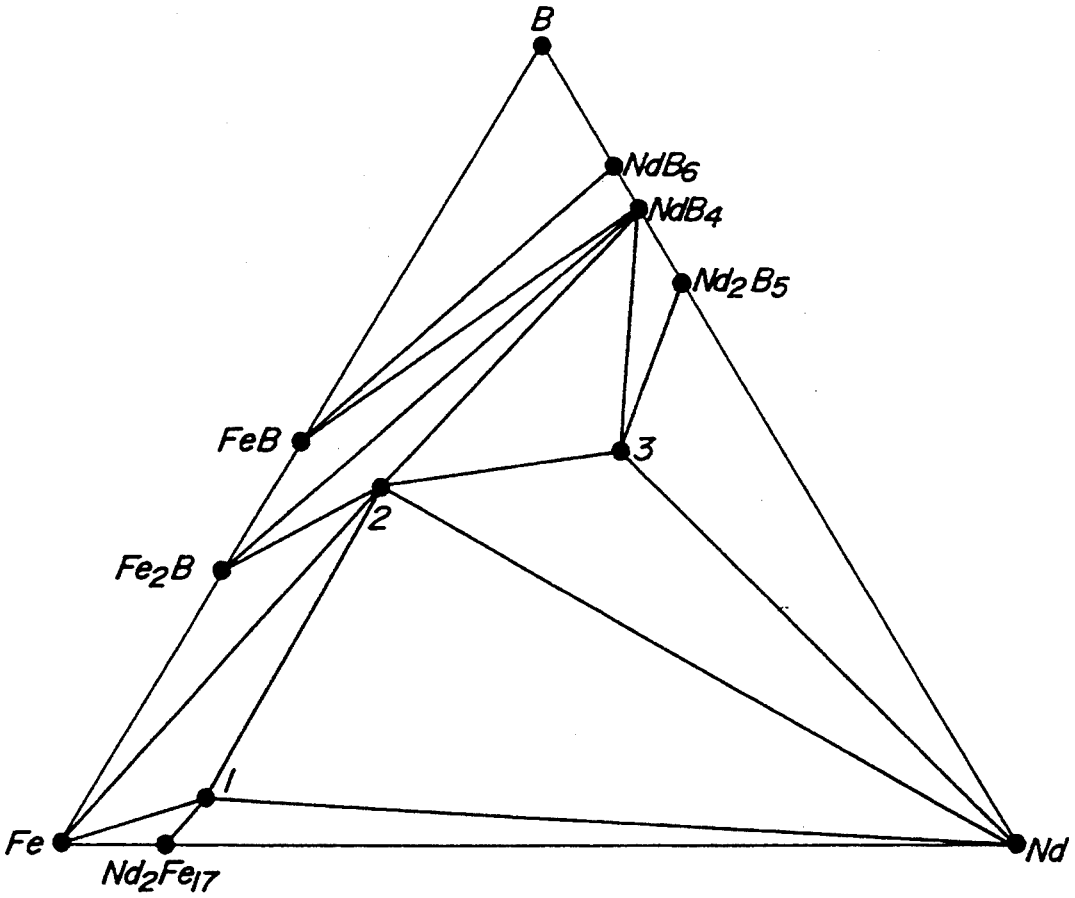
FIG. 1 is a Nd—Fe—B three component phase diagram.
Figure 2:
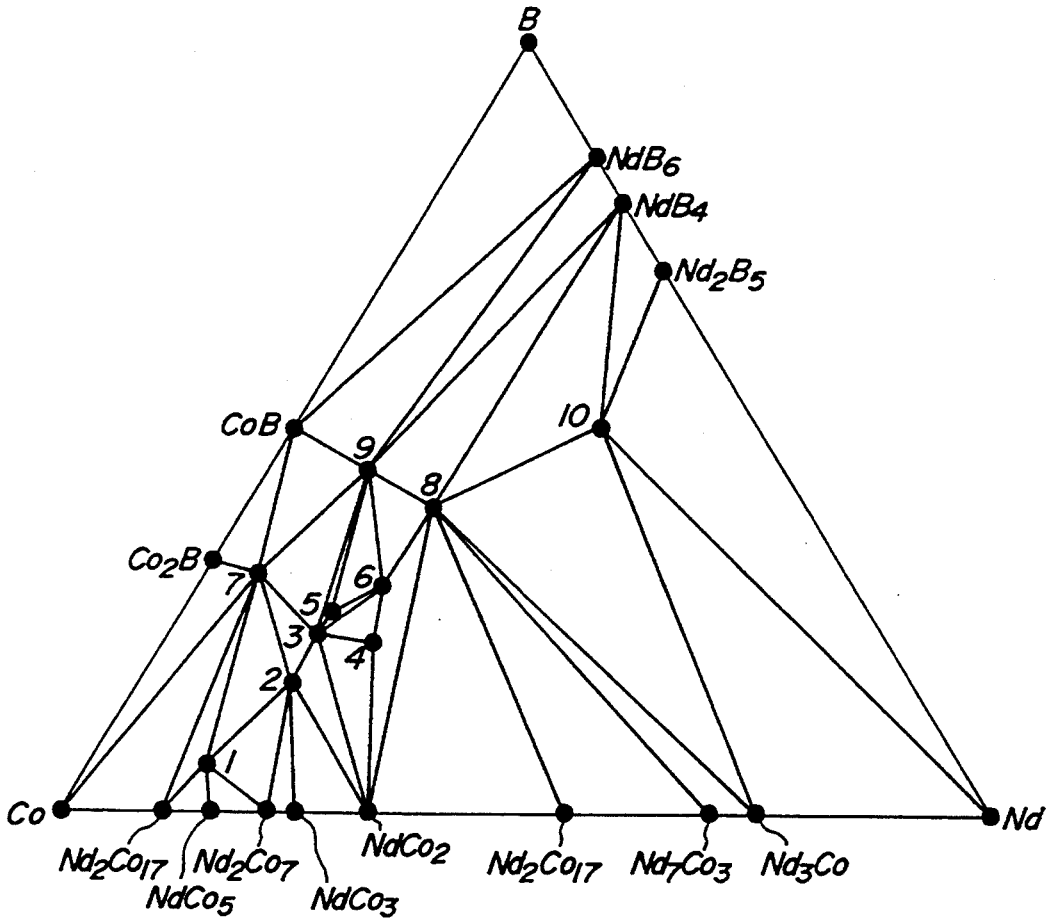
FIG. 2 is a Nd—Co—B three component phase diagram.

For the reference, Nd—Fe—B ternary phase diagram is shown in FIG. 1 (N. F. Chaban, Yu. B. Kuzma, N. S. Bilonizhko, O. O. Kachmar and N. U. Petrov, Akad Nauk, SSSR, SetA, Fiz.-Mat. Tekh, Nauki No. 10 (1979) 873), and Nd—Co—B ternary phase diagram is shown in FIG. 2 (N. S. Bilonizhko and Yu. B. Kuzma, Izv. Akad. Nauk SSSR Neorg. Mater, 19 (1983) 487) (In the original report, $Nd_2Fe_{14}B$ phase and $Nd_2Co_{14}B$ phase are misinterpreted as $Nd_2Fe_{14}B$ phase and $Nd_2Co_9B$ phase, respectively, so that they are corrected in FIGS. 1 and 2).

In FIG. 1, a phase of number 1 is $Nd_2Fe_{14}B$ phase, and $NdFe_4B_4$ phase (phase of number 2), Nd phase, $Nd_2Fe_{17}$ phase and Fe phase appear as a composition near thereto. In FIG. 2, however, $Nd_2Co_{17}$ phase, $NdCo_5$ phase, $Nd_2Co_7$ phase, $NdCo_4B$ phase (phase of number 2) and $NdCo_{12}B_6$ phase (phase of number 7) appear in a magnet prepared from a composition near to $Nd_2Co_{14}B$ phase of number 1, and Nd phase does not naturally appear at an equilibrium state.

As previously mentioned, Nd phase is not only a cause of rust, but also a magnetically useless phase, so that it should be eliminated.

It is, therefore, an object of the invention to provide permanent magnets having excellent magnetic properties and corrosion resistance by using two magnetically useful phases, i.e., (i) $Re_2TM_{14}B$ phase having a high residual magnetic flux density and (ii) a low melting point RE-TM phase or RE-TM-B phase which enhances the sinterability of the magnet and possesses a cleaning action against grain boundaries of the main phase (i). A further object of the invention is to form an electrochemically noble composition as a starting material to prepare a two phase magnet.

That is, the invention lies in a corrosion-resistant rare earth metal-transition metal series permanent magnet consisting essentially of RE: not less than 10 at % but not more than 25 at % (where RE is: one or more of Y, Sc and lanthanoid), B: not less than 2 at % but not more than 20 at %, and the remainder being substantially TM (TM is one or more of Fe, Co and Ni); whose texture comprises (i) a phase of $RE_2TM_{14}B$ (RE and TM are the same as mentioned above) having $Nd_2Fe_{14}B$ structure, and (ii) RE-TM' series intermetallic compound phase (TM' is Ni or a mixture of Ni and Fe or Co) or RE-TM' series eutectic structure (RE and TM' are the same as mentioned above) and/or RE-TM'-B series intermetallic compound phase (RE and TM' are the same as mentioned above), wherein the above phase (ii) has a melting point lower than that of the above phase (i).

Furthermore, the invention lies in a method of producing a corrosion-resistant rare earth metal-transition metal series magnet, which comprises subjecting a mixture of powder composed mainly of $RE_2TM_{14}B$ series intermetallic compound phase (TM is one or more of Fe, Co and Ni) and powder having a melting point lower than that of the above powder and composed of mainly of RE-TM' series intermetallic compound phase (TM' is Ni or a mixture of Ni and Fe or Co) or RE-TM' series eutectic structure (TM' is the same as mentioned above) and/or RE-TM'-B series intermetallic compound phase (TM' is the same as mentioned above) to a compression molding and then sintering it.

In the invention, in order to further improve the corrosion resistance, it is effective to make the intergranular phase electrochemically more noble than the main phase, so that it is preferable that a ratio of Ni and/or Co in TM' of the low melting point RE-TM' and RE-TM'-B series phases is higher than that in $RE_2TM_{14}B$ phase. Particularly, the increase of Ni ratio is effective in the improvement of corrosion resistance and the reduction of cost.

In the invention, it is favorable that a ratio of $RE_2TM_{14}B$ intermetallic compound phase to RE-TM', RE-TM'-B series intermetallic compound phase is about 95:5 to 40:60 as a formula unit. Because, when this ratio is outside the above range, a disadvantage results in that considerable degradation of coercive force and saturated magnetic flux density occurs. The term "formula unit" used herein corresponds to a case that $Nd_2Fe_{14}B$ is considered as one molecule (this is called as formula in the case of a solid). The particle size of each of the above powders to be mixed is desirably about 0.5–5 μm to facilitate handling and homogeneous mixing.

A typical composition of RE-TM' series intermetallic compound phase (inclusive of eutectic structure, same as above) and RE-TM'-B series intermetallic compound phase having a melting point lower than that of $RE_2TM_{14}B$ intermetallic compound phase is as follows.

RE-TM' series $RE_2TM'_{17}$, $RETM'_5$, $RE_2TM'_7$, $RETM'_3$, $RETM'_2$, $RE_1TM'_{1-x}$, $RE_7TM'_3$, $RE_3TM'$ and RE-TM' eutectic structure.

RE-TM'-B Series $RETM'_4B$, $RE_3TM'_{11}B_4$, $RE_2TM'_5B_2$, $RE_2TM'_7B_3$, $RE_2TM'_5B_3$, $RETM'_{12}B_6$, $RETM'_2B_2$, $RETM'_9B_4$, $RE_2TM'B_3$.

Moreover, powder composed mainly of the above $RE_2TM_{14}B$, RE-TM' series and RE-TM'-B series intermetallic compound phases can be obtained as follows.

That is, constitutional elements are weighed so as to have a given composition and shaped into an ingot by arc melting or high frequency melting under vacuum or in an inert gas atmosphere. Then, the ingot is held at a temperature of 600°–1000° C. under vacuum or in an inert gas atmosphere for 1–30 days to form a single phase of intermetallic compound. In general, the intermetallic compound phase usually has a solid solution range to a certain extent (~20%), so that the starting composition is allowed to have a composition width in accordance therewith.

The single phase of the intermetallic compound is roughly ground by means of a hammer mill and then finely divided into a particle size of 0.5–5 μm by using a jet mill or an attritor. Moreover, when the hardness is low and the pulverization is difficult in the low melting point RE-TM' and RE-TM'-B phases, hydrogen brittleness is previously carried out within a temperature range of room temperature to about 350° C. for several hours before grinding with a hammer mill, whereby the subsequent pulverization is easier.

According to the invention, powder composed mainly of the previously prepared intermetallic compound having a composition of $RE_2TM_{14}B$ is mixed with at least one powder composed mainly of the previously prepared RE-TM' series intermetallic compound and RE-TM'-B series intermetallic compound phases having a melting point lower than that of the above powder, pressed and sintered, whereby high magnetic properties and high corrosion resistance can simultaneously be provided.

This is considered to be due to the fact that the powder having a melting point lower than that of the powder composed mainly of $RE_2TM_{14}B$ intermetallic compound phase promotes the sintering and forms an intergranular phase between crystal grains of $RE_2TM_{14}B$ to improve coercive force.

In the $RE_2TM_{14}B$ phase, Nd and Pr are preferred as RE from viewpoints of magnitude of magnetic moment and magnetic coupling with TM atoms, as well as the cost, but it is needless to say that other RE elements or combinations of Nd, Pr therewith may be used.

As to TM, one or more of Fe, Co and Ni is sufficient, and particularly it is preferable to increase the ratio of Ni from a viewpoint of high corrosion resistance of the magnet. Further, the $RE_2TM_{14}B$ phase bears the saturated magnetic flux density of the magnet, so that the ratios of Fe, Co and Ni in TM are desirable to be not less than 10 at % but less than 73 at % Fe, not less than 7 at % but not more than 50 at % Co and not less than 5 at % but not more than 30 at % Ni. Even when the main phase is $RE_2TM_{14}B$ phase in which Fe as TM is 100%, the corrosion resistance of the permanent magnet according to the invention is superior to that of the conventional RE-TM-B magnet, so that the above phase can naturally be used as a main phase in accordance with the use purpose of the magnet.

As RE in the low melting point phase of RE-TM' system and RE-TM'-B system, it is preferred to use light rare earth elements such as La, Ce, Pr, Nd or the like considering the cost, and middle to heavy rare earth elements from Sm to Lu and Y, Sc and the like, from the viewpoint of enhancing corrosion resistance of the magnet.

As to TM', the presence of Ni and/or Co, particularly Ni is effective to improve the corrosion resistance of the magnet, so that according to the invention Ni is necessarily contained as TM'. In this case, the content of TM' is preferable to be not less than about 8%.

The additional effect of Ni is as follows.

i) The melting point of the RE-TM' system and RE-TM'-B system is lowered, and the wetting of liquid phase in the liquid phase sintering is promoted to increase the sintering density and enhance the residual magnetic flux density.

ii) The effect of cleaning grain boundaries in liquid phase is enhanced in the liquid phase sintering to more effectively increase the coercive force by the same reason as in the above item i).

iii) It is effective in improving corrosion resistance and is cheap as compared with Co.

Furthermore, when the ratio of Ni and/or Co in the low melting point phase is made higher than that of $RE_2TM_{14}B$ phase, the corrosion resistance can be improved further, because the phases of these powders tend to preferentially corrode in the grain boundary as compared with $RE_2TM_{14}B$ phase in the sintered body if the structure of TM' is same and is advantageously treated by previously making it electrochemically noble. Furthermore, the magnetically useless Nd phase can be eliminated, so that the residual magnetic flux density increases and hence the maximum energy product $(BH)_{max}$ also increases.

In this connection, even when an alloy having an average composition as a whole magnet is melted from the first as in the conventional technique, pulverized, pressed and sintered so as to approach an equilibrium state, the Nd phase is not obtained. For this purpose, it is necessary to conduct the heating at a high temperature for a long time, during which abnormal growth of crystal grains undesirably results to considerably degrade the coercive force.

Moreover, it is not necessary that the same element is used in RE of the main phase of $RE_2TM_{14}B$ and RE of the low melting point phase. And also, in the magnet consisting of the above two phases, the effect of the invention is not lost even when a part of RE and TM is replaced with at least one of Mg, Al, Si, Ti, V, Cr, Mn, Cu, Ag, Au, Cd, Rh, Pd, Ir, Pt, Zn, Ga, Ge, Zr, Nb, Mo, In, Sn, Hf, Ta and W in an amount up to 8 at % of a full magnet.

As to the production method, a method may be used wherein a mixture of powder of $RE_2TM_{14}B$ composition and powder composed mainly of low melting point RE-TM' series and/or RE-TM'-B series intermetallic compound phases is placed in an iron pipe under vacuum and then sintered while hot rolling as a method of producing large size magnets in addition to the method in which the above powder mixture is subjected to compression molding and then sintered.

BEST MODE FOR CARRYING OUT THE INVENTION

Example 1

An alloy button was prepared by arc melting neodymium, transition metal and boron at an atomic ratio of 2:14:1, which was subjected to a normalizing treatment in a vacuum furnace at 950° C. for 7 days and further to rough grinding and fine pulverization, whereby fine powder having a particle size of a few microns was obtained. In this case, the ratios of Fe, Co, Ni in the transition metal were varied to produce a plurality of alloy powders.

Similarly, powder having a ratio of neodymium or (neodymium+dysprosium) to nickel of 1:1 was prepared. In this case, the normalizing treatment conditions were 680° C. and 5 days.

Then, powders selected from the above two groups were mixed at a mixing ratio shown in Table 1, pressed while applying a magnetic field of 15 kOe, sintered at 1000° C. under vacuum for 2 hours and then quenched to room temperature.

The magnetic properties and corrosion property of the thus obtained samples were measured to obtain the results shown in Table 1. Moreover, the corrosion property was evaluated by exposing the sample to an environment at a temperature of 70° C. and a humidity of 95% for 48 hours and measuring a rusted area ratio on the surface of the sample.

For the comparison, the measured results of a sample produced by the conventional method in which a full composition for the sintered magnet was melted at once and subjected to rough grinding—fine pulverization—pressing in magnetic field—sintering steps are also shown in Table 1.

TABLE 1

| No. | Powder mixing ratio (formula unit ratio %) | | Ratio of transition metals (atomic ratio %) | Composition of magnet (at %) Nd | Dy | Fe | Co | Ni | B | Br (kG) | iHc (kOe) | $(BH)_{max}$ (MGOe) | Rusted area (%) | Remarks |
|---|---|---|---|---|---|---|---|---|---|---|---|---|---|---|
| 1 | $Nd_2TM_{14}B_1$<br>$Nd_1Ni_1$ | 50<br>50 | Fe:Co:Ni<br>100:0:0 | 15.79 | — | 73.69 | — | 5.26 | 5.26 | 12.0 | 7.2 | 32.5 | 11 | Acceptable Example 1 |
| 2 | Arc melting of the above whole composition | | | " | — | " | — | " | " | 13.3 | 5.7 | 35.2 | 30 | Comparative Example 1 |
| 3 | $Nd_2TM_{14}B_1$<br>$Nd_1Ni_1$ | 55<br>45 | Fe:Co:Ni<br>75:25:0 | 15.12 | — | 56.34 | 18.78 | 4.39 | 5.37 | 11.8 | 5.8 | 29.8 | 2 | Acceptable Example 2 |
| 4 | Arc melting of the above whole composition | | | " | — | " | " | " | " | 12.5 | 4.0 | 28.0 | 9 | Comparative Example 2 |

TABLE 1-continued

| No. | Powder mixing ratio (formula unit ratio %) | | Ratio of transition metals (atomic ratio %) | Composition of magnet (at %) Nd | Dy | Fe | Co | Ni | B | Br (kG) | iHc (kOe) | $(BH)_{max}$ (MGOe) | Rusted area (%) | Remarks |
|---|---|---|---|---|---|---|---|---|---|---|---|---|---|---|
| 5 | $Nd_2TM_{14}B_1$<br>$Nd_1Ni_1$ | 50<br>50 | Fe:Co:Ni<br>65:30:5 | 15.8 | — | 47.0 | 22.1 | 8.9 | 5.3 | 11.5 | 13.2 | 32.0 | 0 | Acceptable Example 3 |
| 6 | Arc melting of the above whole composition | | | " | — | " | " | " | " | 12.0 | 4.0 | 26.4 | 6.5 | Comparative Example 3 |
| 7 | $Nd_2TM_{14}B_1$<br>$Nd_1Ni_1$ | 45<br>55 | Fe:Co:Ni<br>65:30:5 | 16.6 | — | 46.8 | 21.6 | 9.9 | 5.1 | 11.6 | 8.0 | 29.6 | 0 | Acceptable Example 4 |
| 8 | Arc melting of the above whole composition | | | ' | — | " | " | " | " | 12.0 | 3.7 | 22.0 | 2 | Comparative Example 4 |
| 9 | $Nd_2TM_{14}B_1$<br>$(Nd_{0.99}Dy_{0.01})_1Ni_1$ | 50<br>50 | Fe:Co:Ni<br>100:0:0 | 15.74 | 0.05 | 73.69 | — | 5.26 | 5.26 | 11.4 | 9.7 | 31.5 | 1 | Acceptable Example 5 |
| 10 | Arc melting of the above whole composition | | | " | " | " | — | " | " | 12.8 | 8.5 | 35.0 | 28 | Comparative Example 5 |
| 11 | $Nd_2TM_{14}B_1$<br>$(Nd_{0.99}Dy_{0.01})_1Ni_1$ | 55<br>45 | Fe:Co:Ni<br>80:20:0 | 15.08 | 0.04 | 56.34 | 18.78 | 4.39 | 5.37 | 11.3 | 8.1 | 30.0 | 3 | Acceptable Example 6 |
| 12 | Arc melting of the above whole composition | | | " | " | " | " | " | " | 12.6 | 5.0 | 31.7 | 7 | Comparative Example 6 |

As seen from the above table, the rare earth metal-transition metal series magnets of two phase structure according to the invention considerably improve not only the magnetic properties but also corrosion resistance as compared with those obtained by melting the full composition as a whole as in the conventional technique.

Example 2

An alloy button was prepared by arc melting neodymium, transition metal and boron at an atomic ratio of 2:14:1, which was subjected to a normalizing treatment in a vacuum furnace at 950° C. for 7 days and further to rough grinding and fine pulverization, whereby fine powder having a particle size of a few microns was obtained. In this case, the ratios of Fe, Co, Ni in the transition metal were varied to produce a plurality of alloy powders.

Similarly, powder having a ratio of neodymium and/or dysprosium or praseodymium to nickel or (nickel+cobalt) of 3:1 was prepared. In this case, the normalizing treatment conditions were 485° C. and 5 days.

The magnetic properties and corrosion property of the thus obtained samples were measured to obtain results shown in Table 2.

For the comparison, the measured results on the properties of a magnet produced by the technique disclosed in Japanese Patent laid open No. 63-164403 are also shown in Table 2.

TABLE 2

| No. | Powder mixing ratio (formula unit ratio %) | | Ratio of transition metals (atomic ratio %) | Composition of magnet (at %) Nd | Dy | Pr | Fe | Co | Ni | B | Br (kG) | iHc (kOe) | $(BH)_{max}$ (MGOe) | Rusted area (%) | Remarks |
|---|---|---|---|---|---|---|---|---|---|---|---|---|---|---|---|
| 13 | $Nd_2TM_{14}B_1$<br>$Nd_3Ni_1$ | 65<br>35 | Fe:Co:Ni<br>100:0:0 | 18.88 | — | — | 73.09 | — | 2.81 | 5.22 | 12.6 | 12.0 | 34.0 | 5 | Acceptable Example 7 |
| 14 | Arc melting of the above hole composition | | | " | — | — | " | — | " | " | 13.1 | 11.2 | 36.2 | 50 | Comparative Example 7 |
| 15 | $Nd_2TM_{14}B_1$<br>$Nd_3Ni_1$ | 65<br>35 | Fe:Co:Ni<br>70:30:0 | 18.88 | — | — | 51.16 | 21.92 | 2.81 | 5.22 | 12.0 | 15.0 | 35.2 | 0 | Acceptable Example 8 |
| 16 | Arc melting of the above whole composition | | | " | — | — | " | " | " | " | 12.8 | 7.9 | 34.8 | 10 | Comparative Example 8 |
| 17 | $Nd_2TM_{14}B_1$<br>$Nd_3Ni_1$ | 65<br>35 | Fe:Co:Ni<br>65:30:5 | 18.88 | — | — | 47.51 | 21.92 | 6.47 | 5.22 | 11.5 | 10.5 | 32.0 | 0 | Acceptable Example 9 |
| 18 | Arc melting of the above whole composition | | | " | — | — | " | " | " | " | 12.3 | 6.8 | 32.2 | 5 | Comparative Example 9 |
| 19 | $Nd_2TM_{14}B_1$<br>$(Nd_{0.97}Dy_{0.03})_3Ni_1$ | 65<br>35 | Fe:Co:Ni<br>80:20:0 | 18.63 | 0.25 | — | 58.48 | 14.61 | 2.81 | 5.22 | 11.6 | 15.5 | 34.0 | 3 | Acceptable Example 10 |
| 20 | Arc melting of the above whole composition | | | " | " | — | " | " | " | " | 12.3 | 8.1 | 32.6 | 20 | Comparative Example 10 |
| 21 | $Pr_2Tm_{14}B_1$<br>$Pr_{2.5}Ni_1$ | 70<br>30 | Fe:Co:Ni<br>85:15:0 | — | — | 16.60 | 64.32 | 11.35 | 2.32 | 5.41 | 11.8 | 9.5 | 33.0 | 2 | Acceptable Example 11 |
| 22 | Arc melting of the above whole composition | | | — | — | " | " | " | " | " | 12.5 | 6.2 | 32.3 | 25 | Comparative Example 11 |
| 23 | $Nd_2TM_{14}B_1$<br>$Nd_3(Ni_{0.8}Co_{0.2})_1$ | 70<br>30 | Fe:Co:Ni<br>80:20:0 | 17.56 | — | — | 59.85 | 15.42 | 1.83 | 5.34 | 12.2 | 10.5 | 35.1 | 3 | Acceptable Example 12 |
| 24 | Arc melting of the above whole composition | | | " | — | — | " | " | " | " | 12.8 | 6.3 | 34.6 | 25 | Comparative Example 12 |

TABLE 2-continued

| No. | Powder mixing ratio (formula unit ratio %) | | Ratio of transition metals (atomic ratio %) | Composition of magnet (at %) Nd | Dy | Pr | Fe | Co | Ni | B | Br (kG) | iHc (kOe) | $(BH)_{max}$ (MGOe) | Rusted area (%) | Remarks |
|---|---|---|---|---|---|---|---|---|---|---|---|---|---|---|---|
| 25 | $Nd_2TM_{14}B_1$<br>$Nd_3(Ni_{0.1}Co_{0.9})_1$ | 65<br>35 | Fe:Co:Ni<br>70:30:0 | 18.88 | — | — | 51.16 | 24.46 | 0.28 | 5.22 | 12.1 | 12.3 | 36.8 | 3 | Acceptable Example 13 |
| 26 | Arc melting of the above whole composition | | | " | — | — | " | " | " | " | 13.3 | 10.1 | 38.0 | 20 | Comparative Example 13 |
| 27 | $Nd_2TM_{14}B_1$<br>$Dy_3Ni_1$ | 55<br>45 | Fe:Co:Ni<br>80:20:0 | 9.87 | 12.11 | — | 55.25 | 13.80 | 4.04 | 4.93 | 7.0 | 28.5 | 17.2 | 3 | Acceptable Example 14 |
| 28 | Arc melting of the above whole composition | | | " | " | — | " | " | " | " | 8.8 | 15.3 | 16.5 | 8 | Comparative Example 14 |
| 29 | $Nd_2TM_{14}B_1$<br>$Nd_3(Co_{0.5}Fe_{0.5})_1$ | 65<br>35 | Fe:Co:Ni<br>70:30:0 | 18.88 | — | — | 52.57 | 23.33 | — | 5.22 | 12.3 | 16.0 | 35.5 | 14 | Conventional Example |

As seen from the above table, the rare earth metal-transition metal series magnets of two phase structure according to the invention are excellent in the magnetic properties and corrosion resistance. Furthermore, when Acceptable Example 8 is compared with Acceptable Example 13, it is apparent that the corrosion resistance is improved as the Ni ratio in $RE_3(Ni, Co)_1$ becomes particularly higher. Moreover, in the conventional example, the magnetic properties are good, but the corrosion resistance is poor because Ni is not contained.

Example 3

A fine alloy powder of $RE_2TM_{14}B$ composition was prepared by the same manner as in Example 1, while a fine alloy powder in which ratios of Ni and Co in TM were made higher than those of $RE_2TM_{14}B$ powder was prepared as a starting powder. After these powders were mixed, a sintered magnet was produced by the same manner as in Example 1.

The properties of the thus obtained sintered magnet are shown in Table 3 together with those of the sintered magnet produced by the conventional method.

TABLE 3

| No. | Powder mixing ratio (formula unit ratio %) | | Ratio of transition metals (atomic ratio %) | Composition of magnet (at %) Nd | Dy | Fe | Co | Ni | B | Br (kG) | iHc (kOe) | $(BH)_{max}$ (MGOe) | Rusted area (%) | Remarks |
|---|---|---|---|---|---|---|---|---|---|---|---|---|---|---|
| 30 | $Nd_2TM_{14}B_1$<br>$NdTM_4B_1$ | 60<br>40 | Fe:Co:Ni<br>65:30:5<br>2.25:61.5:36.25 | 12.69 | — | 43.65 | 27.78 | 7.94 | 7.94 | 11.9 | 7.2 | 31.7 | 0 | Acceptable Example 15 |
| 31 | Arc melting of the above whole composition | | 55:35:10 | " | — | " | — | " | " | 12.7 | 5.1 | 31.5 | 3 | Comparative Example 15 |
| 32 | $Nd_2TM_{14}B_1$<br>$NdTM_4B_1$ | 55<br>45 | 70:30:0<br>17.2:30:52.8 | 12.86 | — | 47.30 | 23.65 | 7.89 | 8.30 | 11.5 | 6.5 | 29.8 | 0 | Acceptable Example 16 |
| 33 | Arc melting of the above whole composition | | 60:30:10 | " | — | " | " | " | " | 12.3 | 4.8 | 30.5 | 3 | Comparative Example 16 |
| 34 | $Nd_2TM_{14}B_1$<br>$NdTM_4B_1$ | 45<br>55 | 100:0:0<br>3.4:58.0:38.6 | 13.24 | — | 47.30 | 23.65 | 7.89 | 8.30 | 11.8 | 8.0 | 32.1 | 0 | Acceptable Example 17 |
| 35 | Arc melting of the above whole composition | | 60:30:10 | " | — | " | " | " | " | 12.6 | 5.2 | 31.7 | 3 | Comparative Example 17 |

As seen from the above table,, when using the fine alloy powder in which the ratios of Ni and Co in TM are higher than those of $RE_2TM_{14}B$ powder as a powder to be mixed, more effective improvement of the corrosion resistance is attained.

INDUSTRIAL APPLICABILITY

According to the invention, the rare earth metal-transition metal series magnets having improved corrosion resistance and magnetic properties can be produced as compared with the conventional production method. Particularly, the corrosion resistance is improved, so that considerable improvement of reliability as an industrial material is realized.

We claim:

1. A corrosion-resistant rare earth metal-transition metal-boron permanent magnet having a rusted surface area ratio of 5% or less after a 48 hour exposure test in air at a temperature of 70° C. and a humidity of 95%, said magnet consisting essentially of RE present in an amount of 10 at % to 25 at %, wherein RE is at least one of Y, Sc, La and lanthanides, B present in an amount of 2 at % to 20 at %, and the remainder being substantially TM, wherein TM is at least one of Fe, Co and Ni, said magnet having a metallographic structure composed of a phase of $RE_2TM_{14}B$ having $Nd_2Fe_{14}B$ structure, and a phase of RENi intermetallic compound.

2. The permanent magnet of claim 1, wherein a portion of RE and TM is replaced with not more than 8 at % of at least one of Mg, Al, Si, Ti, V, Cr, Mn, Cu, Ag, Au, Cd, Rh, Pd, Ir, Pt, Zn, Ga, Ge, Zr, Nb, Mo, In, Sn, Hf, Ta and W.

* * * * *